US010202256B2

(12) United States Patent
MacDonald et al.

(10) Patent No.: US 10,202,256 B2
(45) Date of Patent: Feb. 12, 2019

(54) INTERFACING DESTINATION ENTRY SYSTEM WITH BUILDING SECURITY USING SWITCHES

(71) Applicant: Otis Elevator Company, Farmington, CT (US)

(72) Inventors: Patrick J. MacDonald, Newcastle, WA (US); Greg Barnes, Danville, CA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 439 days.

(21) Appl. No.: 14/905,403

(22) PCT Filed: Jul. 22, 2013

(86) PCT No.: PCT/US2013/051443

§ 371 (c)(1),
(2) Date: Jan. 15, 2016

(87) PCT Pub. No.: WO2015/012787

PCT Pub. Date: Jan. 29, 2015

(65) Prior Publication Data

US 2016/0152439 A1 Jun. 2, 2016

(51) Int. Cl.

| | |
|---|---|
| ***B66B 1/20*** | (2006.01) |
| ***B66B 1/46*** | (2006.01) |
| ***B66B 9/00*** | (2006.01) |

(52) U.S. Cl.

CPC ..... *B66B 1/468* (2013.01); *B66B 1/46* (2013.01); *B66B 9/00* (2013.01); *B66B 2201/4615* (2013.01); *B66B 2201/4676* (2013.01)

(58) Field of Classification Search

CPC .. B66B 1/468; B66B 1/46; B66B 9/00; B66B 2201/4615; B66B 2201/4676

(Continued)

(56) References Cited

U.S. PATENT DOCUMENTS 4,836,336 A * 6/1989 Schroder ..... B66B 1/2458 187/384
5,092,430 A * 3/1992 Goto ..... B66B 1/16 187/383

(Continued)

FOREIGN PATENT DOCUMENTS

CN 102666336 A 9/2012
KR 1020100005871 A 1/2010

(Continued)

OTHER PUBLICATIONS

Chinese Office Action and Search for application CN 201380078429.6, dated Jan. 24, 2017, 13pgs.

(Continued)

*Primary Examiner* — Anthony Salata
(74) *Attorney, Agent, or Firm* — Cantor Colburn LLP

(57) ABSTRACT

A system and method for interfacing a destination entry system with existing security infrastructure of a space. The destination entry system may include at least one destination entry device configured to receive a destination request from a user and an interface device to facilitate communication between the destination entry system and a security system). The interface device may be configured to receive credentials of the user from the security system, co-relate the credentials with areas within a space that the user is authorized to access, identify which one of the at least one destination entry device originated the destination request from the user and communicate the authorized areas and the identified one of the at least one destination entry device to the destination entry system.

18 Claims, 3 Drawing Sheets

(58) Field of Classification Search
USPC ..... 187/247, 277, 380–388, 391, 392, 395, 187/396
See application file for complete search history.

(56) References Cited

U.S. PATENT DOCUMENTS 5,200,583 A * 4/1993 Kupersmith ..... B66B 1/468 187/380
5,679,934 A * 10/1997 Juntunen ..... B66B 1/462 187/384
6,382,363 B1 * 5/2002 Friedli ..... B66B 1/468 187/384
6,397,976 B1 * 6/2002 Hale ..... B66B 1/468 187/384
7,823,700 B2 11/2010 Boss et al.
8,061,485 B2 * 11/2011 Finschi ..... B66B 1/468 187/384
8,151,942 B2 * 4/2012 Rusanen ..... B66B 1/468 187/247
8,490,754 B2 * 7/2013 Amano ..... B66B 1/2458 187/384
8,544,612 B2 * 10/2013 Korhonen ..... B66B 1/468 187/387
8,813,917 B2 * 8/2014 Salmikuukka ..... B66B 1/468 187/247
8,857,569 B2 * 10/2014 Friedli ..... B66B 5/0012 187/384
8,910,752 B2 * 12/2014 Furutani ..... B66B 1/468 187/384
2009/0020370 A1 1/2009 Boss et al.

FOREIGN PATENT DOCUMENTS

KR 2020100009660 U 10/2010
KR 1020120080233 A 7/2012
WO 2012015399 A1 2/2012

OTHER PUBLICATIONS

International Search Report for application PCT/US2013/051443, dated Apr. 16, 2014, 3 pages.
PCT International Search Report for application PCT/US2013/051443, dated Apr. 15, 2014, 6 pages.

* cited by examiner

54
Start
56
Enter destination request
58
Is destination secured?
60
NO
YES
Assign elevator car
62
End
64
Present security credentials
66
Close contacts
68
Determine authorized landing(s) and destination entry device(s) from closed contacts
70
Create and transmit message to destination entry system(s)
72
Is access permitted to requested destination?
74
YES
NO
Access denied
76

INTERFACING DESTINATION ENTRY SYSTEM WITH BUILDING SECURITY USING SWITCHES

TECHNICAL FIELD OF THE DISCLOSURE

The present disclosure relates generally to elevator systems and, more particularly, relates to systems and methods for interfacing destination entry systems with building security infrastructures where elevator systems using destination entry systems may be installed and operated.

BACKGROUND OF THE DISCLOSURE

Elevator systems are widely used throughout the world for transporting users from one point to another. In conventional two button group elevator systems, hall call buttons allow users to request elevator service and, go up or down in a building by selecting a destination on an operating panel located inside an elevator car. While the hall call button arrangement may be useful for many situations, larger buildings with more traffic volume may benefit from other techniques to manage passenger traffic more efficiently. One such technique that has been gaining popularity is known as a destination entry system.

In a destination entry system, a passenger may request a desired destination on a destination entry device located outside the elevator cars. Based on the desired destination, each passenger may be assigned to an elevator car within the group elevator system that most efficiently transports the passenger to their desired destination. Often, security features may be associated with the destination entry device to prevent unauthorized access to the group elevator system. For example, the destination entry system may be configured to assign an elevator car only to authorized patrons of the building where the destination entry system is installed. Thus, before assigning an elevator car, a user requesting access to the group elevator system may be requested to present credentials at a credential receiver device or to enter a code via a keypad.

The credential receiver device may be associated with existing security infrastructure of the building. However, to use the credential receiver device for credential verification before elevator assignment, the destination entry system may need to be integrated with the security system of the building as well. Two mechanisms have been conventionally used to integrate and/or use the destination entry device with the credential receiver device and, therefore, with the building's security.

The first technique involves installing the credential receiver device such as a card reader inside the elevator cars. Using this technique, the elevator system may assign an elevator car without requesting a security credential. After boarding the assigned elevator car but before the elevator doors close, the user is required to present security credentials at the credential receiver device. If the credential receiver device is unable to authenticate the user, the user's call is cancelled and the user exits the elevator car to try again.

An alternate technique enables user authentication before the elevator system assigns an elevator car to the user. With this technique, a destination entry system may be integrated with security system such that when a user makes a destination request, the security system first authenticates the user before the destination entry system assigns the user an elevator car. While this method is superior to the first technique, the integration of the destination entry system with the security system often requires specific qualified vendors to supply a new or upgraded system specifically designed to integrate the two systems. It may also require a building to upgrade its existing credential receiver devices and/or other security infrastructure to be able to accommodate the destination entry system. Upgrading or adding new functionality to integrate the destination entry system with existing security system devices and other building security infrastructure may be prohibitively complex and expensive, insomuch as building managers may be deterred from seeking the benefits of the destination entry system.

Accordingly, it would be beneficial if an improved mechanism to integrate the destination entry system with a building's existing security system could be developed. It would additionally be beneficial if such a mechanism could provide the advantages of the second technique discussed above without the complexity and expense associated therewith.

SUMMARY OF THE DISCLOSURE

In accordance with one aspect of the present disclosure, a destination entry system is disclosed. The destination entry system may include at least one destination entry device configured to receive a destination request from a user and an interface device to facilitate communication between the destination entry system and a security system. The interface device may be configured to receive credentials of the user from the security system, co-relate the credentials with areas within a space that the user is authorized to access, identify which one of the at least one destination entry device originated the destination request from the user and communicate the authorized areas and the identified one of the at least one destination entry device to the destination entry system.

In accordance with another aspect of the present disclosure, a method of managing elevator traffic is disclosed. The method may include receiving a destination request from a user on a destination entry system and determining areas within a space that the user may be authorized to access by an interface device. The method may also include assigning an elevator car by the destination entry system to the user if the destination request is to one of the areas within the space that the user is authorized to access.

In accordance with yet another aspect of the present disclosure, an elevator system is disclosed. The elevator system may include at least one group elevator system having a plurality of elevator cars and a destination entry system located at a fixed distance from the at least one group elevator system. The destination entry system may have a destination entry device configured to receive a destination request from a user and a security system configured to receive credentials of the user. The destination entry kiosk may also include an interface device configured to receive the credentials, identify floors within a building that the user may be authorized to access, identify the destination entry device that originated the destination request and generate a message indicating the floors that the user may be authorized to access.

These and other aspects and features will become more apparent upon reading the following detailed description and accompanying drawings.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION OF THE DISCLOSURE

Figure 1:
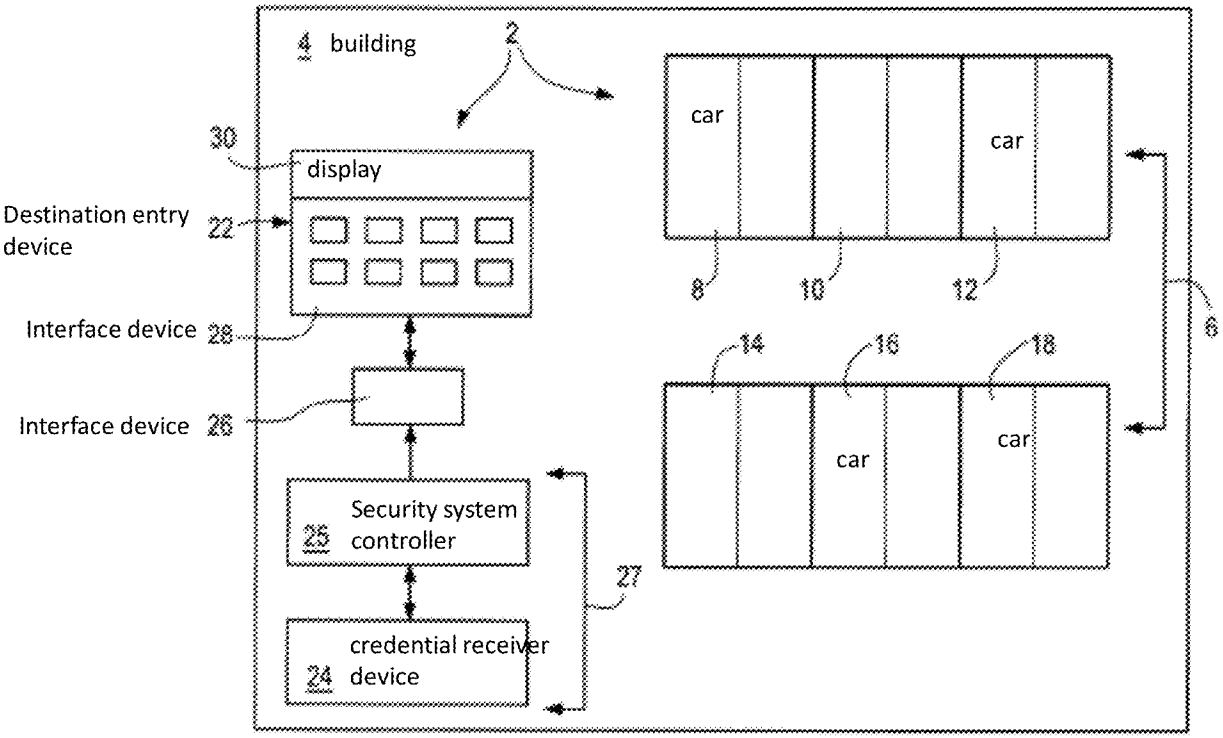
FIG. 1 is a schematic block diagram of an exemplary destination entry system installed in a building, in accordance with at least some embodiments of the present disclosure.

Referring to FIG. 1, a schematic block diagram of an exemplary destination entry system 2 installed in a building 4 is shown, in accordance with at least one embodiment of the present disclosure. As shown, the destination entry system 2 may include a group elevator system 6 having a plurality of elevator cars 8, 10, 12, 14, 16 and 18. The elevator cars 8-18 may be selectively assigned to a user desiring access to a space within the building 4 that is serviced by the group elevator system 6. The destination entry system 2 may also include a destination entry device 22 to facilitate assignment of the elevator cars 8-18 to the user. The destination entry device 22 may be located at a distance from the group elevator system 6. The destination entry system 2 may further include an interface device 26 for facilitating communication between the destination entry system and a security system 27.

Notwithstanding the fact that in the present embodiment, a single one of the group elevator system 6 having six of the elevator cars 8-18 has been shown within the building 4, this is merely exemplary. In other embodiments, depending upon the size and needs of the building 4 where the destination entry system 2 is installed, additional group elevator systems may be provided. Furthermore, each of the group elevator system 6 within the building 4 may have more or less than six elevator cars. It will also be understood that while the present disclosure has been described in relation to a building, this is also exemplary. The present disclosure may be employed in any application using one or more elevator cars and where a destination entry system is installed.

With respect to the destination entry device 22, users may use the destination entry device to request assignment of one of the elevator cars 8-18 to their desired destination within the building 4. The destination entry device 22, in at least some embodiments, may include a keypad or touch screen 28 having a display 30. The destination entry device 22 may also have audio, visual, tactile and/or other capabilities designed to provide feedback to a user. In other embodiments, other types of destination entry devices that are capable of receiving inputs from a user and further capable of providing some feedback/output back to the user may be employed as well. In a further embodiment, the destination entry device 22 may be a wireless communication device such as a cell phone that may communicate wirelessly with the elevator system 2. While not shown, the destination entry device 22 may be associated with other components of the destination entry system 2, such as but not limited to an elevator controller or other type of controller configured to operate in conjunction with the destination entry device.

Referring still to FIG. 1, the security system 27, in at least some embodiments, may include a credential receiver device 24 configured to receive security credential verification from a user requesting access to the group elevator system 6. Particularly, the credential receiver device 24 to verify the credentials of a user may be employed when the destination entry system 2 determines that the destination requested by the user is to a secured landing (e.g., floor) within the building 4. As used herein, a "secured" landing means that only authorized users and personnel may access that space or floor of the building 4. Relatedly, an "unsecured" landing means that no specific authorization is needed to access that space or floor of the building 4.

The credential receiver device 24 may take a variety of forms. For example, in some embodiments, the credential receiver device 24 may take the form of a card reader. The card reader may be able to receive credential identification, for example, by enabling a user to swipe, scan or wave an identification card to the card reader. In other embodiments, devices such as radio frequency transceivers, fingerprint recognition devices, voice recognition devices, electronic key readers, keypad for receiving a security code and/or other types of devices capable of verifying user credentials may be used. As will be discussed below, upon presentation of identification credentials on the credential receiver device 24, the security system 27 and particularly, a security system controller 25 of the security system may actuate or change the state of various contacts 32 representing landings or areas that the user may have permission to access.

Furthermore, the destination entry device 22 and the credential receiver device 24 may be located at a fixed distance from the group elevator system 6. For example, in at least some embodiments, the destination entry device 22 and the credential receiver device 24 may be located in a lobby of the building 4 such as near the main entrance of the building. In other embodiments, the destination entry device 22 and the credential receiver device 24 may be located in other conveniently accessible location of the building 4. Typically, the destination entry device 22 and the credential receiver device 24 may be positioned adjacent to each other to conveniently enable a user to present credentials quickly after requesting a destination, although this may not always be necessary.

Moreover, while in the present embodiment, only one of the destination entry devices 22 for the group elevator system 6 has been shown, in other embodiments, more than one destination entry device may be provided for each of the group elevator systems in the building 4. Relatedly, in some embodiments, a single one of the destination entry device 22 may be employed for multiple group elevator systems.

Figure 2:
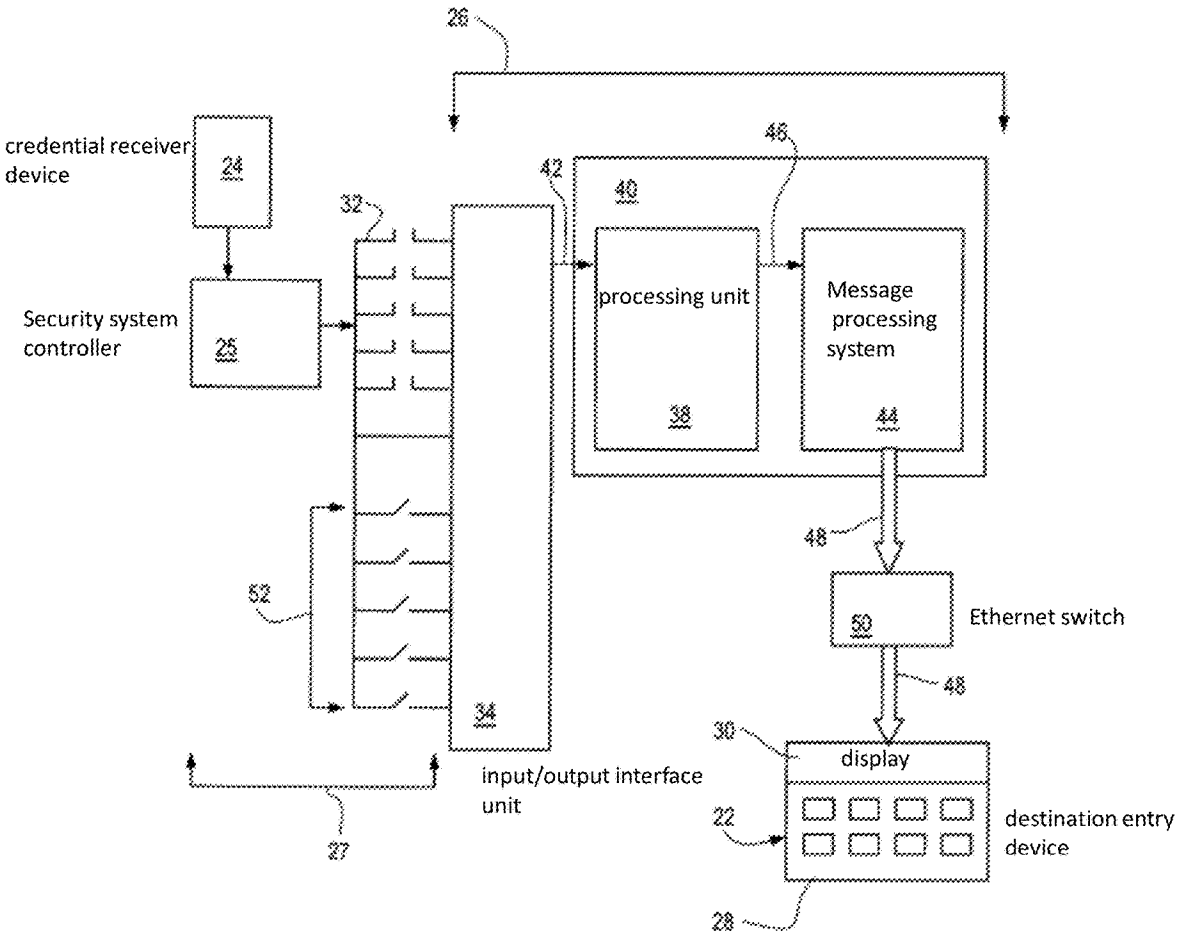
FIG. 2 is a schematic block diagram of an exemplary interface device employed in the destination entry system of FIG. 1.

Turning now to FIG. 2, an exemplary one of the interface device 26 is shown, in accordance with at least some embodiments of the present disclosure. As discussed above, the interface device 26 may facilitate communication between the destination entry system 2 and the security system 27 when a user desires access to a secured landing of the building 4. However, in contrast to the destination entry device 22 of the destination entry system 2 and the credential receiver device 24 of the security system 27, both of which may be located in a public space (such as a lobby) within the building 4, the interface device 26 may be located in a machine room of the group elevator system 6 and separate from the destination entry device and the credential receiver device.

The interface device 26 may be in communication with the security system 27 via the contacts 32. A landing within the building 4 may be associated with one or more of the contacts 32 or, alternatively, a single one of the contacts may be associated with one or more landings. Notwithstanding the fact that in the present embodiment, only five of the contacts 32 have been shown, in other embodiments, the number of contacts may vary depending upon the number of secured and unsecured landings within the building 4. Further, the contacts 32 may be dry, relay or other type of secondary contacts capable of closing and opening upon instruction from the security system 27 and particularly, from the security system controller 25 in communication with both the credential receiver device 24 and the contacts. The security system controller 25 may be associated with and controlled by the existing security infrastructure (e.g., the security system 27) of the building 4.

When the credential receiver device 24 of the security system 27 receives user credentials (e.g., in response to a request from the destination entry system 2), in at least some embodiments, the credential receiver device may communicate with the security system controller 25, which in turn may determine which landings (whether secured or unsecured) the user is authorized to access. Upon determining the authorized landings, the security system controller 25 may close one or more of the contacts 32 corresponding to the authorized landings. For example, if a user is authorized to access only the fifth floor within the building 4, the credential receiver device 24 after reading the user credentials may communicate with the security system controller 25, which may then determine from the user credentials that the user is authorized to access only the fifth floor of the building 4. The security system controller 25 may then cause the contacts 32 associated with the destination entry device 22 on which the request is made to close for the fifth floor.

If the user is authorized to access multiple floors (for example, third, fourth and fifth floors) within the building 4, then the security system controller 25 after reading the user credentials may cause the contacts 32 associated with the third, fourth and fifth floors for the destination entry device 22 on which the request is made to close. As will be described further below, the contacts 32 that close may be same as or different from the destination that the user may have requested access to on the destination entry device 22.

The closing of the contacts 32 may be read by a change in state (e.g., from open to close) of the contacts by an input/output interface unit 34 of the interface device 26 and transferred to a processing unit 38 of an interface computer system 40 via communication link 42. The input/output interface unit 34 may be any of a known variety of input/output interface units that are capable of reading inputs of closed or opened contacts/switches and further capable of transferring those inputs to a processing system. The processing unit 38, upon receiving the information of the change in state of the contacts 32 (e.g., those contacts that have changed from an open state to a closed state), may co-relate the change in state of the contacts with spaces within the building 4 that the user making the request may be authorized to access from the destination entry device 22 on which the request was made.

The processing unit 38 may also determine the identity of the destination entry system 2 and particularly, of the destination entry device 22 within the destination entry system that originated the destination request based on the change in state of the contacts 32. Such matching of the change in state of the contacts 32 with the identity of the destination entry device 22 in the destination entry system 2 may be useful when more than one destination entry device is employed within the building 4. Without a matching of the change in state of the contacts 32 with the identity of the destination entry device 22, the processing unit 38 may not know which destination entry device originated the request to send the list of authorized spaces to. Therefore, when the security system 25 causes the contacts 32 to close, the processing unit 38 may determine which of the destination entry device 22 is associated with the contacts 32 that closed.

Also, when multiple ones of the contacts 32 are closed, the processing unit 38 may match each closed contact with a corresponding one of the destination entry device 22 associated with that particular contact. Thus, if five of the contacts 32 are closed, then the processing unit 38 may determine the identity of the destination entry device 22 for each of those five contacts. The destination entry device 22 for each of the five closed ones of the contacts 32 may either be the same (e.g., when only one destination entry device exists within the building 4) or different (e.g., when multiple destination entry devices are present within the building).

After associating each one of the contacts 32 which underwent a change in state with a corresponding floor within the building 4 and the destination entry device 22, the processing unit 38 may transfer the identities of the floor(s) and the destination entry device(s) to a message processing system 44 of the interface computer system 40 via a communication link 46. The message processing system 44 may create a message for the destination entry system 2 associated with the destination entry device 22 identified by the processing unit 38 indicating to it all of the landings that the user requesting a destination may be authorized to access. Thus, if the processing unit 38 determines that a user requesting access to the group elevator system 6 at the destination entry device 22 is authorized to only access the fifth floor within the building 4, the message processing system 44 may create a message for the destination entry system 2 associated with that destination entry device saying that the user is authorized to access only the fifth floor. Again, the floor(s) and the destination entry device(s) 22 that the message processing system 44 creates a message to are identified by the processing unit 38.

Typically, a single message is created by the message processing system 44 for each one of the destination entry device 22 within the building 4. Even when a user at the destination entry device 22 may be authorized to access multiple landings within the building 4, the message processing system 44 may only generate a single message that identifies all of those multiple landings that the user can access. The generated message may be transmitted via Ethernet 48 and an Ethernet switch 50 to the destination entry system 2. The message processing system 44, in at least some embodiments, may be capable of receiving feedback from the destination entry system 2 as well. As will be described further below, based upon the message received from the message processing system 44, the destination entry system 2 and particularly, the destination entry device 22 on which the request originated, may either assign or refuse assignment of the elevator cars 8-18 to the user.

In least some other embodiments of the present disclosure, instead of the contacts 32, switches 52 may be employed for granting or denying access to a specific landing within the building 4. For example, the switches 52 may be employed to grant access to guests or visitors going to a special event happening on a particular secured floor of the building 4 without asking for security credentials. After the event, the switches 52 may again be employed to convert the unsecured floor back into a secured floor. Thus, the switches 52 may be employed to grant access to the building 4 to users who would generally be unauthorized.

The switches 52 may be controlled by the security personnel of the building 4 to essentially make one or more secured landings unsecured, that is to allow access to those landings to unauthorized users. Alternatively, the switches 52 may be employed to convert one or more unsecured landings into secured landings. Similar to the contacts 32, at least one of the switches 52 may be associated with each secured and unsecured landing of the building 4. The switches 52 may be any of a wide variety of switches that may commonly be employed in security settings. For example, in some embodiments, the switches 52 may be toggle switches. In other embodiments, the switches 52 may be rotary switches, momentary switches, roller switches, push button type switches, other commonly used electromechanical switches or other devices capable of providing a selective switching action.

Thus, when one or more of the switches 52 are closed or opened by the security (or other authorized) personnel of the building 4, an otherwise secured (or unsecured) landing of that building may be converted to an unsecured (or secured) landing. When a user requests access to a landing which has been converted to an unsecured landing by closing at least one of the switches 52, the destination entry device 22 may assign one of the elevator cars 8-18 to the user without asking for security credentials.

Specifically, when one or more of the switches 52 are closed or opened, the input/output interface unit 34 may read the state of the switches and may transmit that information to the processing unit 38 of the interface computer system 40. The processing unit 38 may co-relate the state change of the switches 52 with the associated landing(s) and one or more of the destination entry device 22. The identities of the landing(s) and the one or more of the destination entry device 22 may be input into the message processing system 44, which may generate a message for each associated one of the destination entry device 22 indicating that the landings of the building 4 corresponding to the ones of the switches 52 whose states were changed are now unsecured (or secured).

Referring still to FIG. 2, the interface computer system 40, in at least some embodiments, may be a stand-alone embedded or general purpose computer system having any of a variety of volatile or non-volatile memory/storage devices (not shown) such as, flash memory, read only memory (ROM), programmable read only memory (PROM), erasable programmable read only memory (EPROM), electronically erasable programmable read only memory (EEPROM), etc. The processing unit 38 and the message processing system 44 of the interface computer system 40 may be any of a variety of processing devices, such as, microprocessors and central processing units. The interface computer system 40 may also be configured to receive and process, or used in conjunction with, computer readable media, such as, joy sticks, flash drives, optical disc drives, floppy discs, magnetic tapes, drums, cards, etc., as well as output and display devices such as monitors and printers, as may be desired. Other types of computing, processing as well as reporting and storage devices may be present within (or used in conjunction with) the interface computer system 40.

Furthermore, the interface computer system 40 and particularly, the processing unit 38 and the message processing system 44 of the interface computer system may run one or more software programs or applications stored in a memory location, read from a computer readable medium, and/or accessed from an external device operatively coupled to the interface computer system by any suitable communication network.

The interface computer system 40 along with the input/output interface unit 34, the contacts 32 and the switches 52 may all be located within a machine room of the group elevator system 6 in at least some embodiments. In other embodiments, one or more of the interface computer system 40, the input/output interface unit 34, the contacts 32 and the switches 52 may be located in a different location within the building 4 or possibly at a remote location outside the building.

In another embodiment of the present disclosure, instead of communicating with the destination entry device 22, the interface device 26 may communicate with a controller (not shown) of the group elevator system 6. Specifically, the message processing system 44 of the interface device 26, instead of transmitting the messages to the destination entry system 2, may transmit those messages to the controller of the group elevator system 6. The controller upon receiving the message from the message processing system 44 may determine whether to assign one of the elevator cars 8-14 to the user requested destination or not. The controller may then communicate with the destination entry system 2, which may then cause the destination entry device 22 to display (or communicate with the user by other mechanisms) the findings of the controller.

Thus, for example, if the controller determines that the user may be assigned one of the elevator cars 8-14 to its requested destination (e.g., because the user is requesting access to a landing he/she is authorized to access), then the controller may assign an elevator car to the user and relay the information of the assigned elevator car to the destination entry system 2. The destination entry system 2, by way of the destination entry device 22, may then relay the information of the assigned elevator car to the user. Similarly, if the controller of the group elevator system 6 determines that the user is not authorized to access his/her requested destination, then the controller may deny access to an elevator car to the user and may transmit the denial to the destination entry system 2. The destination entry system 2 (again by way of the destination entry device 22) may then relay the denial to the user.

By virtue of the interface device 26 communicating with the controller of the group elevator system 6 instead of the destination entry system 2, the controller and not the destination entry system may determine whether to give access to the user to the group elevator system 16 and if so, which one of the elevator cars 8-14 within the group elevator system to assign.

In yet another embodiment of the present disclosure, the interface device 26 may continue to communicate with the destination entry system 2, similar to the embodiment described with respect to FIG. 2 above. However, in contrast to the embodiment of FIG. 2, in the present embodiment, the destination entry system 2 may merely receive the message from the message processing system 44 and may transfer that message to the controller (again, not shown) of the group elevator system 6. The controller may determine from the message whether the user may be allowed to access its requested destination. The controller may also assign one of the elevator cars 8-14 to the user if the user is authorized to access the destination. Alternatively, the controller may determine that the user is not authorized to access its requested destination and may deny assignment of the elevator cars 8-18. The controller may then communicate with the destination entry system 2, which may by way of the destination entry device 22, relay the assignment or denial to the user.

Furthermore, in each of the embodiments described above (including the embodiment of FIG. 2), the input/output interface unit 34 may be a bi-directional input/output unit capable of providing (and in at least some instances receiving) feedback from the security system controller 25. As discussed above, the security system controller 25 may be associated with the existing security infrastructure of the building 4. Specifically, the input/output interface unit 34 may be capable of relaying the information of the destination floor selected by the passenger by changing the state of the contacts 32 for the security system controller 25. In at least some embodiments, the security system controller 25 may mine the information of the change in state of the contacts 32 to determine a user's most frequently visited landings within the building 4. In other embodiments, the security system 25 may use the information of the change in state of the contacts 32 to determine other types of information, such as the most frequently visited landings within the building 4, etc. The security system may utilize the collected information to enhance or otherwise modify its security features and offerings within the building 4.

INDUSTRIAL APPLICABILITY

In general, the present disclosure sets forth a destination entry system that may assign a user an elevator car in advance of boarding. The destination entry system may include a destination entry device on which a user may request a destination. The destination entry system may communicate with a security system having a credential receiver device. The destination entry system may communicate with the security system by way of an interface device. The interface device may include an input/output interface unit configured to read change in state of contacts facilitated by the security system and further configured to transmit those inputs to a processing unit of an interface computer system. The input/output interface unit may also be configured to communicate the change in state of the contacts to a security system associated with the existing building infrastructure of the building. The change in state of the contacts may correspond to all of the authorized landings within the building that the user may be authorized to access.

The processing unit may co-relate the change in state of the contacts with specific authorized landings within the building and also with the specific destination entry device(s) making the request. A message processing system within the interface computer system may utilize the information from the processing unit to generate a message noting the destination entry device(s) identified by the processing unit. The generated message may be transmitted to the destination entry system with which the identified destination entry device(s) may be associated.

Figure 3:
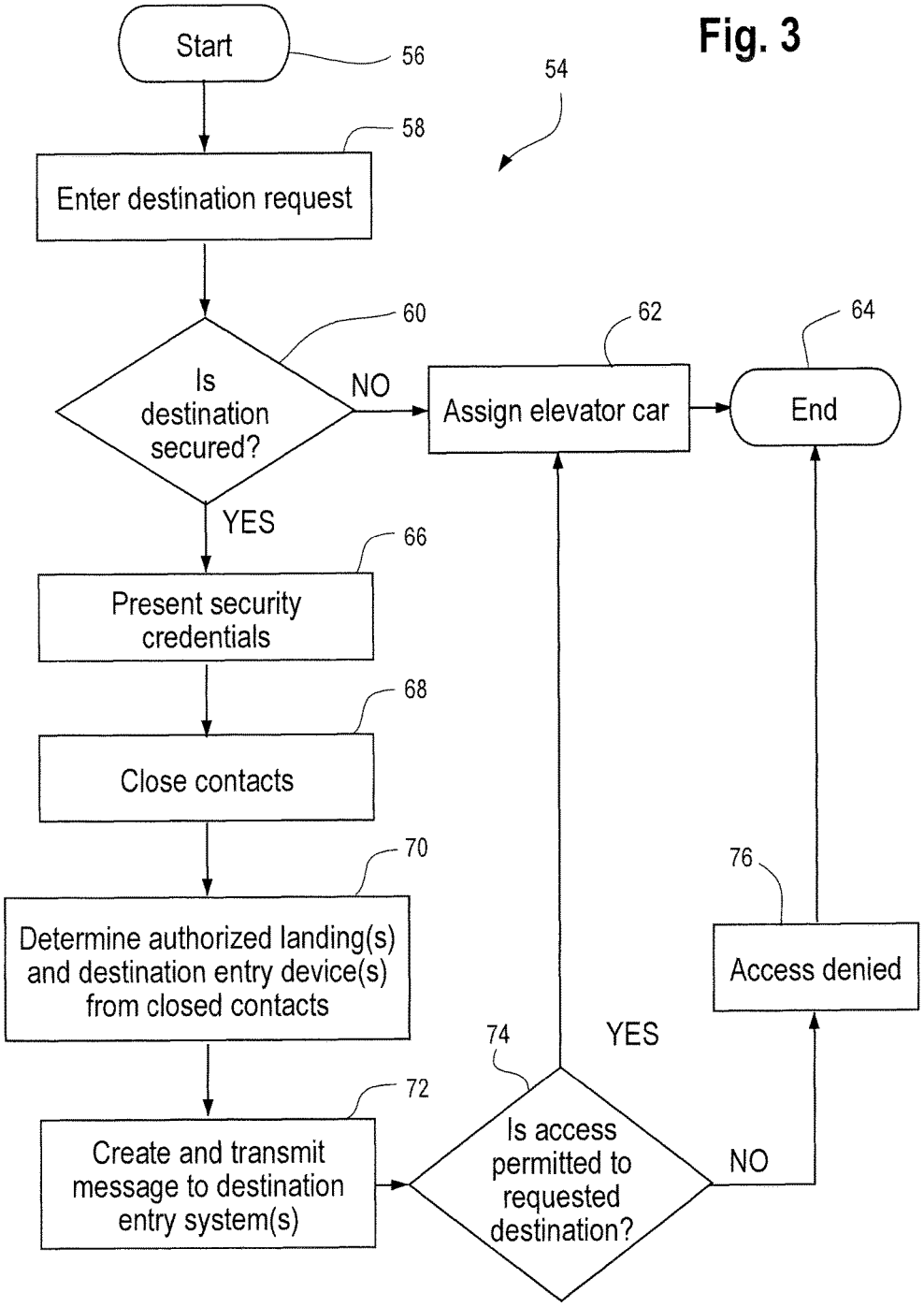
FIG. 3 is an exemplary flowchart outlining the steps of managing user traffic by way of the destination entry system of FIG. 1.

Turning now to FIG. 3, a flowchart 54 outlining the steps of managing user traffic using the destination entry system 2 is shown, in accordance with at least some embodiments of the present disclosure. After starting at a step 56, a user may enter its desired destination (for example, the fifth floor) within the building 4 at a step 58 on the destination entry system 2. Specifically, the user may enter its destination request on the destination entry device 22 of the destination entry system 2 associated with the group elevator system 6 within the building 4 that the user may be seeking access to. When more than one of the destination entry devices 22 are present for each of the group elevator system 6, the user may find a destination entry device that is not being used to enter its desired destination.

After receiving the user's desired destination on the destination entry device 22, the destination entry system 2 may determine whether the requested destination (e.g., the fifth floor) is a secured landing at a step 60. Information regarding which landings are secured and which ones are unsecured may be pre-determined and pre-programmed within the destination entry system 2. If the destination entry system 2 determines at the step 60 that the requested destination is not a secured landing (and therefore is an unsecured landing), the destination entry device 22 at a step 62 may assign the user one of the elevator cars 8-18 within the group elevator system 6 in advance of boarding. The process may then end at a step 64 and the destination entry device 22 may become available for the next user.

On the other hand, if at the step 60, the destination entry system 2 determines that the requested destination (e.g., the fifth floor) is to a secured landing within the building 4, then at a step 66, the destination entry device 22 may request the user to present security or authorization credentials to the security system 27. Specifically, the user may present the security or authorization credentials to the credential receiver device 24 of the security system 27. As discussed above, for each authorized user within the building 4, the security system 27 may have stored therein (or somehow have accessible to it) information regarding all of the landings within the building that the particular user may access. Further, each landing within the building 4 may have associated therewith at least one of the contacts 32 and the contacts may be at least indirectly connected to the credential receiver device 24.

Thus, when the user present its credentials to the credential receiver device 24, the security system controller 25, which the credential receiver device may be in communication with, may change the state of all of the contacts 32 corresponding to the user's authorized landing(s) at a step 68. For example, if the user is authorized to access floors one through eight within the building 4, the security system controller 25 may cause all of the contacts 32 associated with the floors one through eight to change in state (e.g., close). Again, it will be understood that the destination that the user requests on the destination entry device 22 may be different from the landing(s) that the user may actually be authorized to access.

For example, the user may request its destination to be the fifth floor even though that user may not actually be authorized to access the fifth floor. Regardless of the requested destination, the security system controller 25 may only determine all of the landings that the user may actually access. Therefore, if the security system controller 25 determines that the user may only access the first and the third floors within the building 4, the security system controller 25 may cause the contacts 32 associated with the first and the third floors to change in state even though the user may have requested access to the fifth floor. As will be discussed further below, when the security system controller 25 via the interface device 26 transmits the information of the authorized landing(s) of a particular user to the destination entry system 2, the destination entry system may determine whether the user is actually authorized to access its requested destination or not.

Next, at a step 70, the change in state of the contacts 32 may be read by the input/output interface unit 34 of the interface device 26 and transmitted to the processing unit 38. The processing unit 38 may co-relate the change in state of the contacts 32 with the corresponding landing(s) within the building 4 and also with the destination entry device 22 making the request. As discussed above, co-relating the change in state of the contacts 32 with the particular destination entry device 22 may be useful when multiple destination entry devices are present within the building 4. The processing unit 38 may transfer the identities of the landings(s) and the destination entry device 22 to the message processing system 44, which at a step 72 may generate a message for the destination entry device.

One message for each one of the destination entry device 22 may be generated. The message may include information of all the landing(s) that the user may be authorized to access. This message may be transmitted to the destination entry system 2 associated with the identified destination entry device 22. After receiving the message from the message processing system 44, the destination entry system 2 at a step 74, may compare the user requested destination with the actual authorized landings and may determine whether to allow the user access to its requested destination. If the destination entry system 2, at the step 74, determines that the user may be allowed access to its requested destination, then the destination entry device 22 may assign the user one of the elevator cars 8-18 in the group elevator system 6 at a step 62 and the process may end at the step 64. In addition, the interface device 26 may change the state of one of the contacts 32 to provide an indication of the selected destination to the security system 27. On the other hand, if the destination entry system 2, at the step 74, determines that the user is not authorized to access its requested destination, then the destination entry system may deny an elevator assignment at a step 76 and the destination entry device 22 may generate an error or warning message to the user. The process may then end at the step 64. The above process may be repeated for the next user.

It will be understood that references to the various floors of the building 4 throughout the present disclosure are merely for explanation purposes and not intended to limit the scope of the disclosure in any way. Rather, the destination entry system is intended to operate and selectively assign elevator cars to all spaces within the building 4 that may be serviced by the group elevator system 6, as well as by any other elevator systems that may be present within the building and that have the destination entry system associated with them.

Thus, the present disclosure provides a simple mechanism to integrate the destination entry system with the security system without requiring the building to upgrade or change their existing security infrastructure. The interface device, which facilitates the communication between the destination entry system and the security system, also does not necessitate any complex changes in the functionality of the existing destination entry systems. Furthermore, the interface device is simple to install, inexpensive (relative to the complex and expensive conventional techniques) and can be retrofitted in existing group elevator systems. Moreover, by virtue of using the interface device, the credential receiver devices may be provided outside of the elevator systems such that user credentials may be verified before assigning an elevator car to the user. The functionality of the interface device may also be expanded to incorporate additional features as may be desired such as capability to facilitate inter-floor transfer.

While only certain embodiments have been set forth, alternatives and modifications will be apparent from the above description to those skilled in the art. These and other alternatives are considered equivalents and within the spirit and scope of this disclosure and the appended claims

What is claimed is:

1. A destination entry system, comprising:

at least one destination entry device configured to receive a destination request from a user;

an interface device to facilitate communication between the destination entry system and a security system, the interface device configured to receive credentials of the user from the security system, co-relate the credentials with areas within a space that the user is authorized to access, identify which one of the at least one destination entry device originated the destination request from the user and communicate the authorized areas and the identified one of the at least one destination entry device to the destination entry system;

at least one switch in at least indirect communication with the interface device, each at least one switch associated with one of the areas within the space that are accessible, wherein an unsecured landing is converted to a secured landing by changing status of a switch associated with a landing to be converted.

2. The destination entry system of claim 1, wherein the interface device includes an input/output interface unit configured to receive the credentials of the user at least indirectly from the security system.

3. The destination entry system of claim 2, wherein the input/output interface unit transfers the credentials of the user to a processing unit within the interface device.

4. The destination entry system of claim 1, wherein the interface device further includes a message processing system configured to communicate at least indirectly with the destination entry system, the message processing system configured to generate messages identifying the authorized areas within the space.

5. The destination entry system of claim 4, wherein the message processing system generates one message for each one of the at least one destination entry device in each of the destination request from the user.

6. The destination entry system of claim 1, wherein the interface device communicates with the destination entry system via Ethernet.

7. The destination entry system of claim 1, further including at least one contact in at least indirect communication with the security system and the interface device, each of the at least one contact associated with one of the areas within the space that are accessible.

8. A method of managing elevator traffic, the method comprising:

receiving a destination request from a user on a destination entry system;

determining by an interface device areas within a space that the user is authorized to access; and assigning an elevator car by the destination entry system to the user if the destination request is to one of the areas within the space that the user is authorized to access;

wherein an unsecured landing is converted to a secured landing by changing status of a switch associated with a landing to be converted, the switch in at least indirect communication with the destination entry system.

9. The method of claim 8, wherein receiving the destination request comprises determining by the destination entry system if the destination request is to a secured landing or an unsecured landing.

10. The method of claim 9, wherein if the destination request is to the unsecured landing, a destination entry device of the destination entry system assigns the elevator car (8-18) to the user without asking for credentials of the user.

11. The method of claim 9, wherein if the destination request is to the secured landing, the destination entry system requires the user to present credentials to a security system before assigning the elevator car to the user.

12. The method of claim 11, wherein determining the areas within the space that the user is authorized to access comprises closing at least one contact when the credentials of the user are presented to the security system.

13. The method of claim 8, wherein determining the areas within the space that the user is authorized to access comprises identifying a destination entry device of the destination entry system that originated the destination request.

14. The method of claim 13, wherein determining the areas within the space that the user is authorized to access comprises generating a message to the identified destination entry device that originated the destination request, the message identifying the areas that the user is authorized to access.

15. An elevator system, comprising:

at least one group elevator system having a plurality of elevator cars; and a destination entry system in communication with the at least one group elevator system, the destination entry system having a destination entry device configured to receive a destination request from a user; and an interface device configured to receive the credentials from a security system, identify floors within a building that the user is authorized to access, identify the destination entry device that originated the destination request and generate a message to the destination entry system indicating the floors that the user is authorized to access;

wherein the interface device is in at least indirect communication with at least one switch, each of the at least one switch associated with at least one floor within the building that is accessible, wherein an unsecured landing is converted to a secured landing by changing status of a switch associated with a landing to be converted.

16. The elevator system of claim 15, wherein the interface device is configured to integrate with existing security infrastructure of the building.

17. The elevator system of claim 15, wherein the interface device includes a processing unit that identifies the floors that the user is authorized to access and the destination entry device that originated the destination request, the interface device also including a message processing system that generates the message for the destination entry system indicating the floors that the user is authorized to access.

18. The destination entry system of claim 1, wherein the at least one switch comprises and electromechanical switch.

* * * * *